US006027175A

United States Patent [19]

Seear et al.

[11] Patent Number: 6,027,175

[45] Date of Patent: Feb. 22, 2000

[54] METHOD AND APPARATUS FOR HIGHWALL MINING

[75] Inventors: Peter Kenneth Seear, Franklin, Pa.; Bret Edward Leisemann, Queensland, Australia

[73] Assignee: Cutting Edge Technology Pty Ltd., Australia

[21] Appl. No.: 08/757,659

[22] Filed: Nov. 29, 1996

[30] Foreign Application Priority Data

Nov. 29, 1995 [AU] Australia ..... PN6889
Jul. 3, 1996 [AU] Australia ..... PO0824

[51] Int. Cl.[7] ..... E21C 29/02; E21C 31/10

[52] U.S. Cl. ..... 299/18; 299/76

[58] Field of Search ..... 299/18, 64, 67, 299/76, 78

[56] References Cited

U.S. PATENT DOCUMENTS 4,014,574 3/1977 Todd ..... 299/18 X
4,641,889 2/1987 Brandl ..... 299/76 X
4,878,714 11/1989 Barnthaler et al. ..... 299/76 X
4,953,915 9/1990 Jasser et al. ..... 299/64 X
5,364,171 11/1994 Addington et al. ..... 299/67 X

FOREIGN PATENT DOCUMENTS

44812/79 9/1979 Australia .

*Primary Examiner*—Hoang C. Dang
*Assistant Examiner*—Sunil Singh
*Attorney, Agent, or Firm*—Whitman Breed Abbott & Morgan LLP

[57] ABSTRACT

A method of highwall mining, the method includes providing a continuous miner (11) connected to a car train (12) extending to a launch vehicle (13). As the miner (11) progresses down an inclined mine tunnel (15) additional cars are added to the train (12) at the launch vehicle (13). The launch (13) applies a force to the end car so that the car adjacent the mine (11) provides a reaction force for the miner (11).

13 Claims, 9 Drawing Sheets

METHOD AND APPARATUS FOR HIGHWALL MINING

TECHNICAL FIELD

The present invention relates to methods and apparatus for highwall mining and more particularly to methods and apparatus for highwall mining where the mine floor is inclined downwardly from the mine tunnel entrance.

BACKGROUND OF THE INVENTION

In previous highwall systems, a variety of thrusting mechanisms have been employed. Systems employing only a thrust generating mechanism from the outside of the highwall entry have been limited in hole depth and effectiveness by a lack of sumping control of the continuous miner. Alternatively, systems employing only thrust systems which are located along the train have been difficult to retract out of the mined entry and control during mining. Systems which employ thrust generating mechanisms mounted in the trains and at the launch vehicle are difficult to integrate, control and maintain.

OBJECTS OF THE INVENTION

It is the object of the present invention to overcome or substantially ameliorate the above disadvantage.

SUMMARY OF THE INVENTION

There is disclosed herein a method of highwall mining comprising the steps of:

providing a continuous miner having a cutter head;

attaching to the miner a train of cars to receive mined material provided by the miner, the cars extending from the miner in a direction opposite the normal mining direction of travel of the miner; and applying a force to the train at a position remote from the miner so as to provide for advancement of the train down an inclined mine tunnel while enabling the train to provide a reaction force for forces generated by the miner, when required.

There is further disclosed herein a miner comprising:

a chassis;

non driven tracks supporting the chassis on a ground surface;

a cutter head supported on the chassis for movement in a direction generally transverse and longitudinal of the intended direction of movement of the miner;

a first hydraulic ram operatively extending between the chassis and cutter head to cause the transverse movement of the cutter head; and a second hydraulic ram connected to the cutter head for attachment to an end car of a mine car train to cause the longitudinal movement of the cutter head.

BRIEF DESCRIPTION OF THE DRAWINGS

A preferred form of the present invention will now be described by way of example with reference to the accompanying drawings wherein:

FIG. 12 illustrates the cascading conveyors while FIG. 13 illustrates that each conveyor car employs an individual powered drive.

DETAILED DESCRIPTION OF THE PREFERRED EMBODIMENT

Figure 1A:
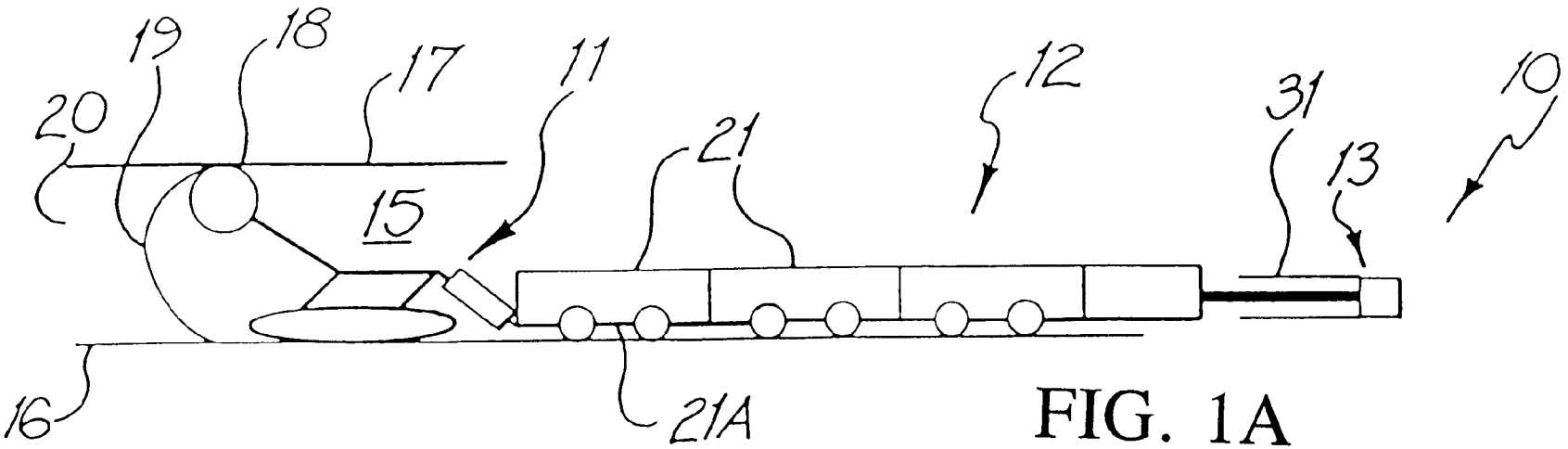
FIGS. 1A–1D is a schematic side view of a continuous miner and car train attached thereto, with the miner and train depicted in a sequence of operations.

In the accompanying drawings there is schematically depicted an apparatus 10 for highwall mining. The apparatus 10 includes a miner 11 from which there trails a car train 12. The car train 12 has at its upper end a launch vehicle 13 associated with a bunker car 14.

The apparatus 10 is designed to operate and form a mine tunnel 15 having a mine floor 16 and a mine roof 17 included to the horizontal up to about 20 degrees.

The highwall mining apparatus 10 is intended to be controlled from the launch vehicle 13 which is intended to be located "above ground" and preferably adjacent to the entrance to the tunnel 15.

In operation of the above described apparatus 10, the cutting head 18 of the miner 11 takes the material to be mined from the mine face 19. For example, the material to be mined may be coal located in a seam 20.

In operation of the above described apparatus 10, the cutting head 18 rotates about a generally horizontal axis transverse of the tunnel 15. The mined coal is delivered to the conveyor cars 21 forming the train 12. The cars 21 each have a length of conveyor so that the mined material is moved along the length of the cars 21 to be deposited at the launch vehicle 13. There the mined material is delivered via the transverse conveyor 35 to the bunker car 14 or other vehicle to transport the mined coal.

As the face 19 is mined, the miner 11 and its associated train are moved down the formed tunnel 15. As required, additional cars 21 are added to the train 12 as the miner 11 descends down the tunnel 15.

The miner 11 includes a chassis 22 supported on tracks 23 which are not driven. Supported on the chassis 22 is a cutter head support assembly 24 supporting the cutting head 18. The member 25 is itself supported by a link 26 and a hydraulic ram 27. The ram 27 basically controls pivoting of the member 25 and more particularly vertical movement of the cutting head 18. The assembly 24 further includes a pair of links 28 and 29 which cooperate with a hydraulic ram 30. The links 28 and 29 and ram 30 basically provides forward movement of the cutting head 18 by causing pivoting of the ram 27 and link 26 about the pivot 52.

The ram 30 extends to the lower most car 21A. In that regard the train 12 provides a reaction force for the ram 30, so that the ram 30 when extended moves the cutting head 18 into the face 19 as best seen in FIG. 1(*b*). The ram 27 is then operated to move the cutting head down until it reaches the position basically seen in FIG. 1(*c*). The ram 27 is then reversed to raise the cutting head 18 to the position basically shown in FIGS. 1(*a*) and (*d*). Again the hydraulic ram 30 is operated to move the cutting head 18 into the mine face 19. During this operation, the lower most car 21A (by moving the train 12) is moved down the tunnel 15 in a coordinated manner with the operation of the above discussed rams 27 and 30.

Figure 1B:
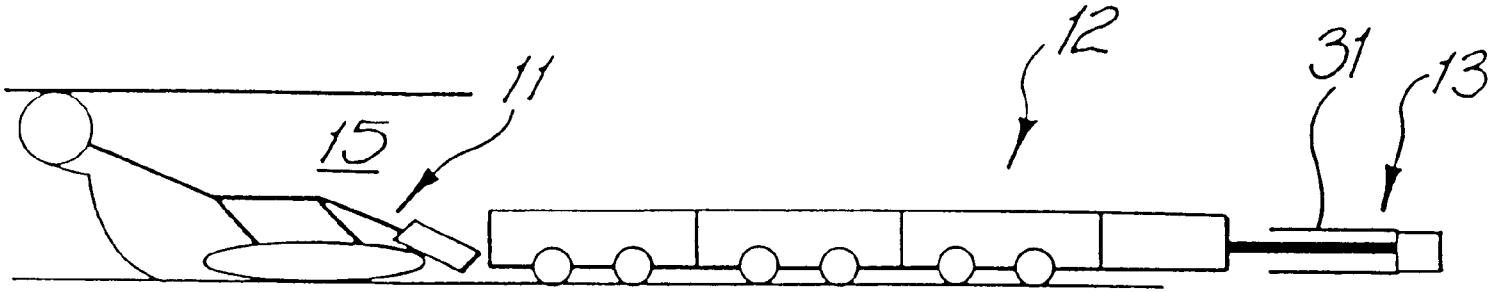
Figure 1C:
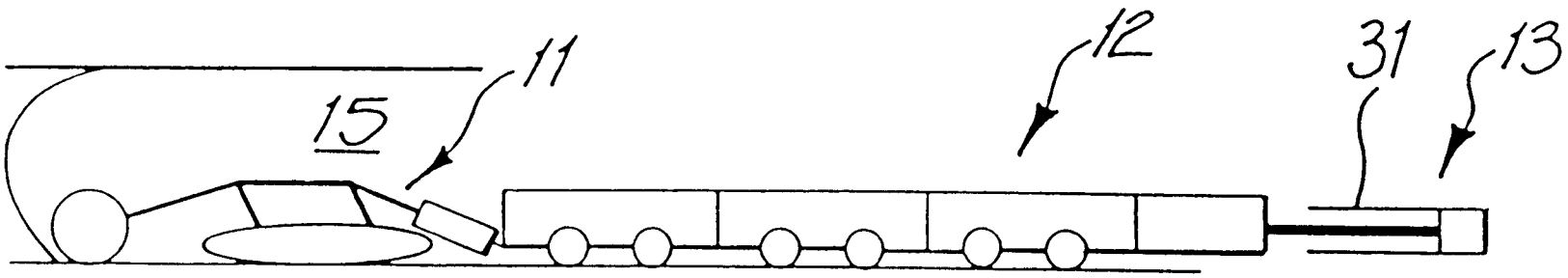
Figure 1D:
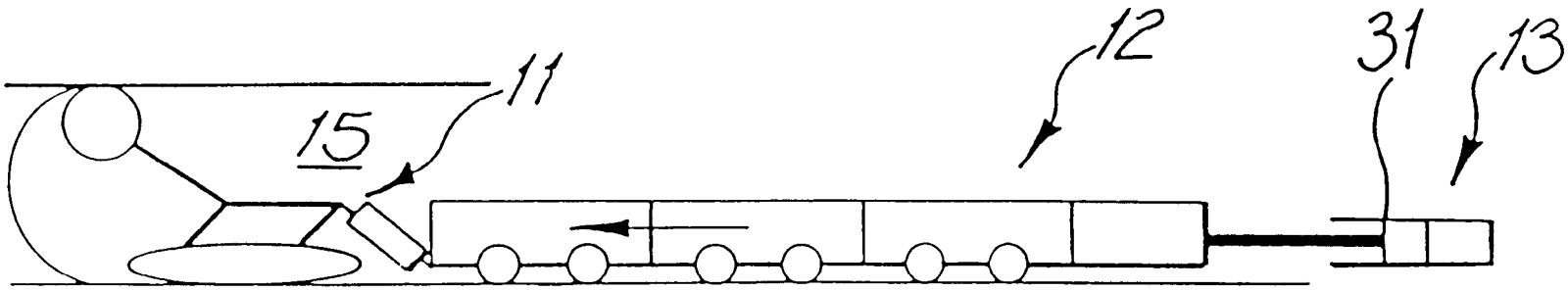
Figure 2:
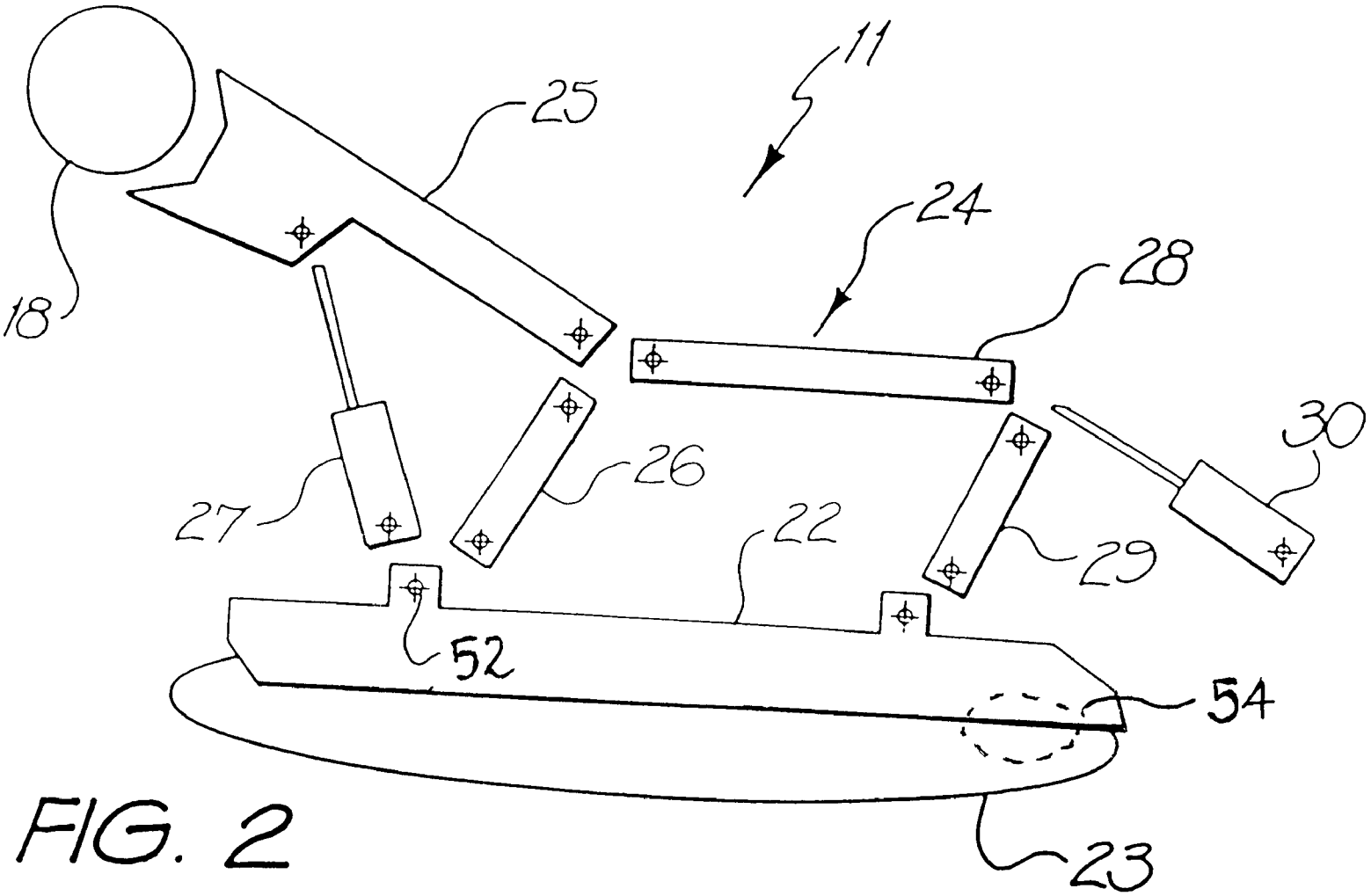
FIG. 2 is a schematic side elevation of the continuous miner of FIG. 1.
Figure 3:
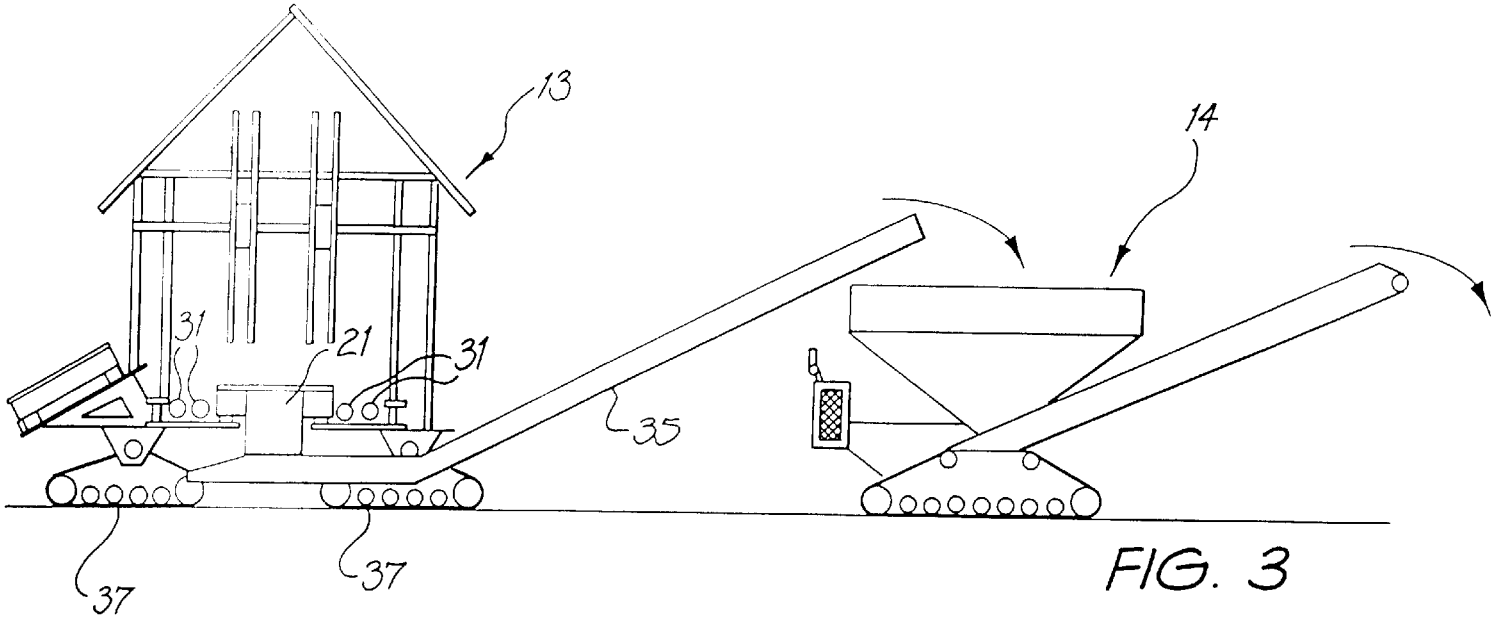
FIG. 3 is a schematic end elevation of a launch vehicle and bunker car to be used with the miner and train of FIG. 1.
Figure 5:
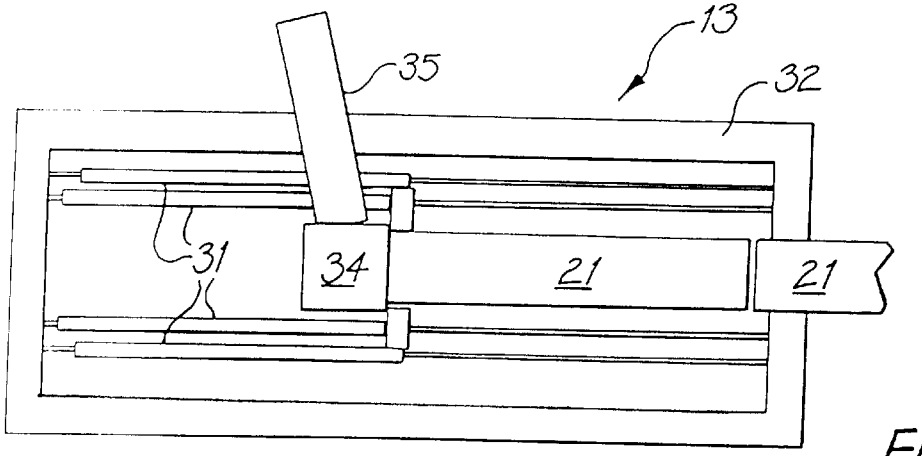
FIG. 5 is a schematic top plan view of a portion of the launch vehicle of FIG. 3.
Figure 4:
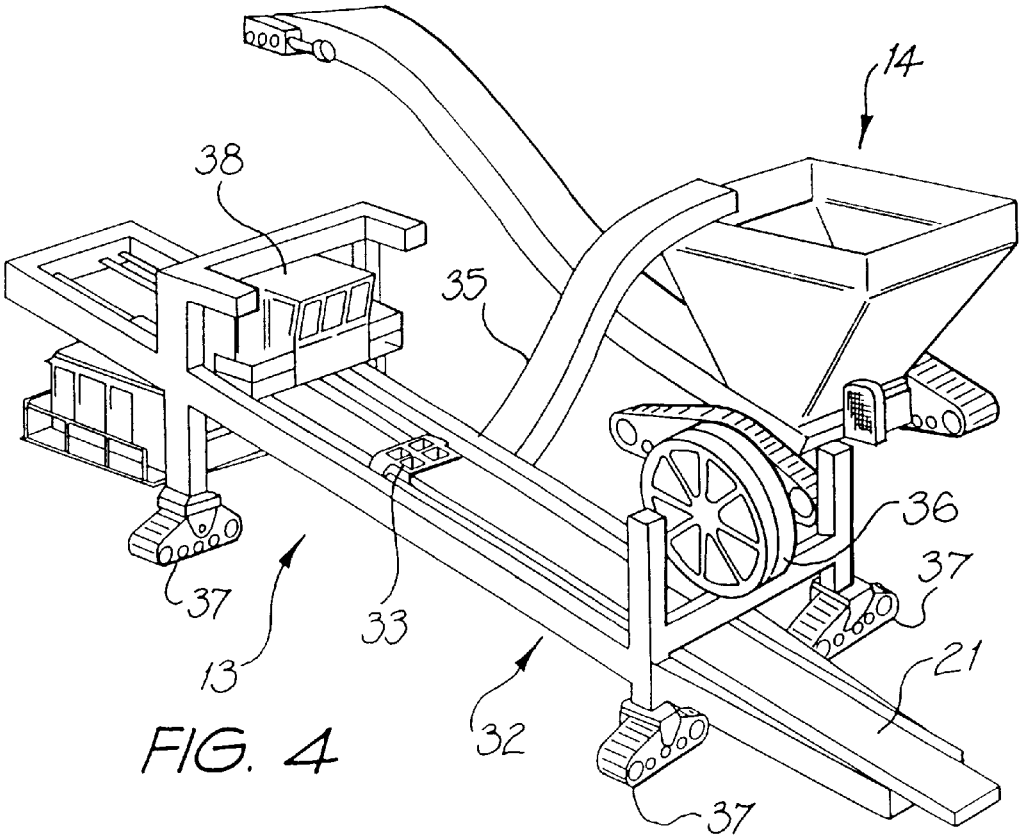
FIG. 4 is a schematic perspective view of the launch vehicle and bunker car of FIG. 3.
Figure 6:
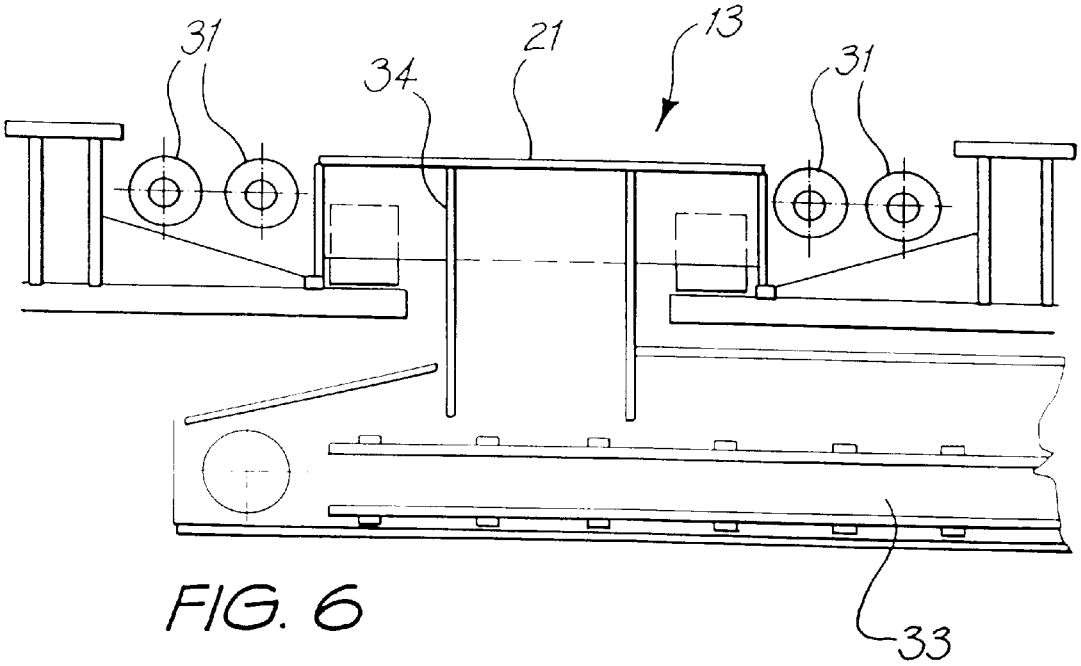
FIG. 6 is a schematic section end view of a portion of the launch vehicle of FIGS. 3, 4 and 6.

Accordingly, in the above described method of operation of the apparatus 10, sumping (movement of the cut head 18 longitudinally of the seam 20—as best seen in FIG. 1B) as well as shearing (movement of the cutter head 18 transverse of the seam 20—as best seen in FIG. 1C) is done while the train is stationary. This provides for accurate sumping and shearing at the coal face.

The cars 21 are pivotable relative to each other only about horizontal axes extending generally transverse of the tunnel 15. That is they are restrained to pivot relative to each other only about a generally horizontal axis normal to the longitudinal direction of the tunnel 15.

The launch vehicle 13 includes a plurality of hydraulic rams 31 which govern movement of the train 12 and therefore the position of the vehicle 11. The rams 31 cooperate with the gravitational force applied to the train 12 and vehicle 11 to adjust the force supplied to the cutting head 18 in its contact with the mine face 19. For example, initially, when the train 12 is relatively short, the rams 31 would provide a force in the direction of extension of the tunnel 15 so as to force the cutting head 18 against the face 19. As the train 12 increases in length, and additional mined product is supported thereby, the rams 31 may need to be actuated so as to apply a force in the opposite direction to aid in supporting the train 12, its mined product and the vehicle 11 so as to maintain a desired force against the cutting head 18. Accordingly, part of the train 12 would be in tension in inclined seam conditions.

Thus, in this embodiment, two co-operative hydraulic systems effectively manage and accurately control cutting forces and cutter head spatial displacements (movements) at extended hole depths and at significant inclines.

The launch vehicle 13 includes a frame 32. As the train 12 moves down the tunnel 15, additional cars 21 are added to the frame 32 and linked to the train 12. In this regard, it should be appreciated that the link between adjacent cars 21 is positive so that the only relative movement is basically a pivoting movement about a generally horizontal axis transverse of the tunnel 15.

Figure 12:
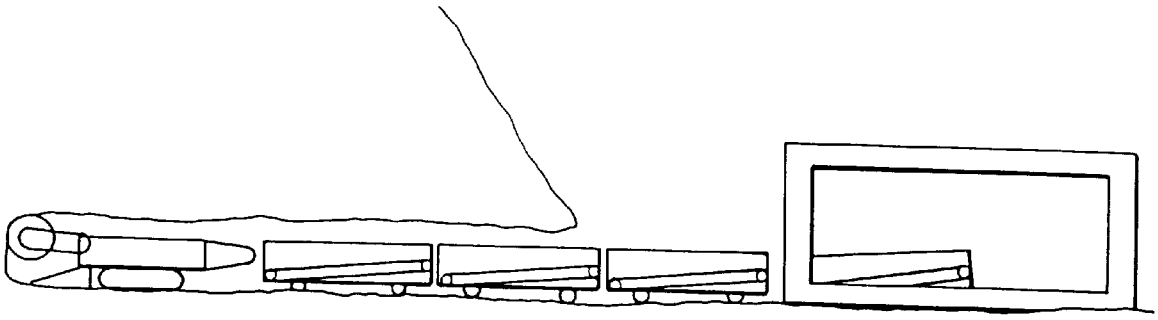
FIGS. 12 and 13 depict an alternative design illustrating cascading conveyor means, such as conveyor belts or conveyor chains.
Figure 13:
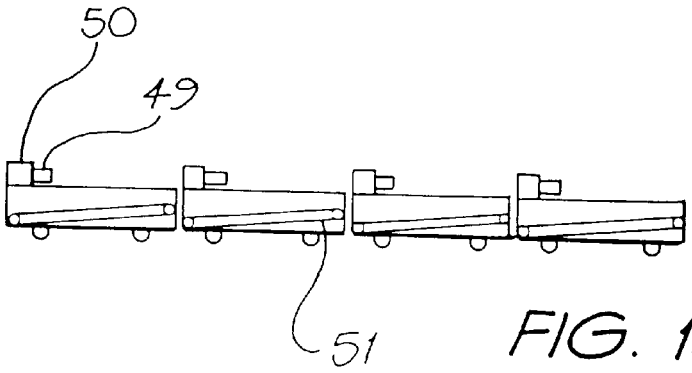

In the embodiment of FIGS. 12 and 13, the conveyor means may include cascading conveyor belts or conveyor chains 51. The conveyor cars may also be adapted to include individual power drives 49 and associated power transfer apparatus 50.

Each car 21 terminates with a rear chute 33 through which material is delivered to be deposited on the next adjacent following train 21. Alternatively, in respect of the last car 21, the chute 33 would be located above a further chute 34 leading to a transverse conveyor 35 to deliver mined product (such as coal) to a "bunker" vehicle 14.

Mounted on the frame 32 are the hydraulic cylinders 31 which apply the required force to the last car 21.

Figure 7:
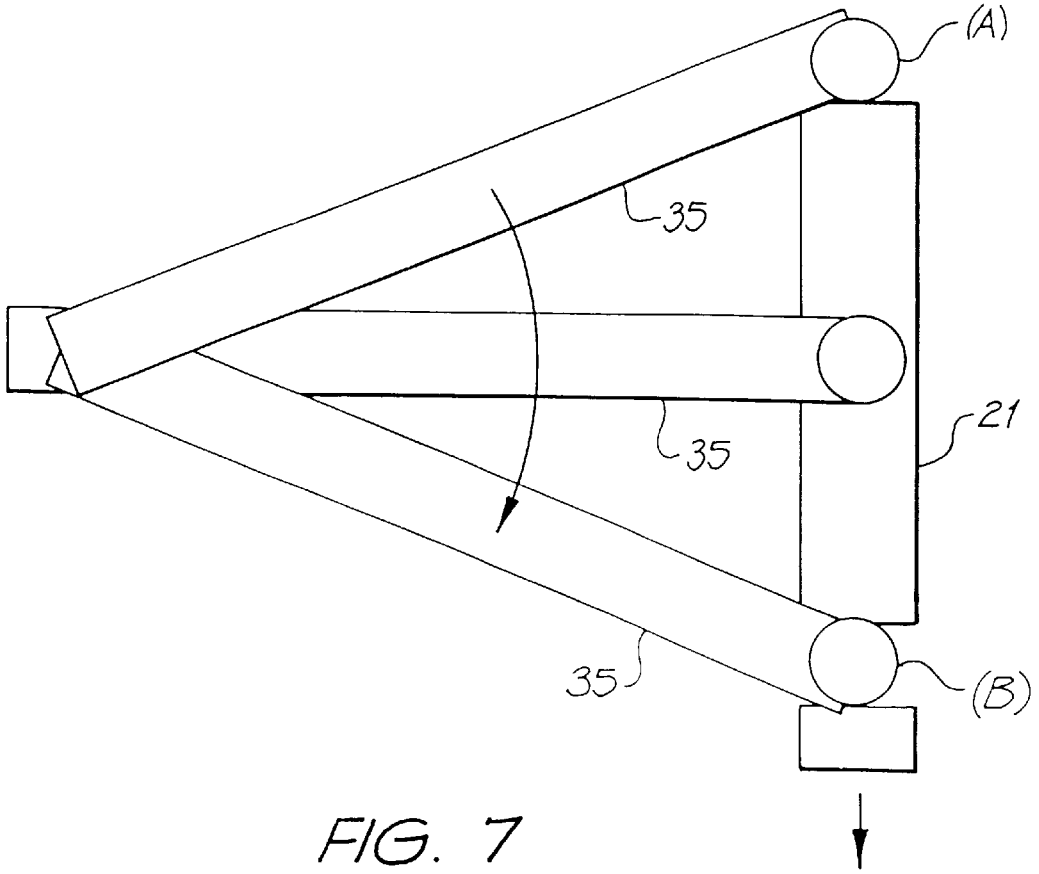
FIG. 7 is a schematic top plan view of a portion of the launch vehicle of FIGS. 3 and 4.
Figure 8:
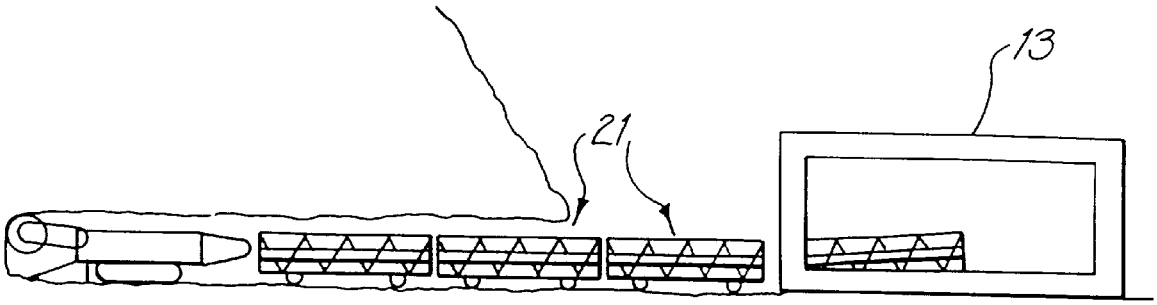
FIGS. 8 to 10 are schematic side view of a continuous miner and car train attached thereto.
Figure 9:
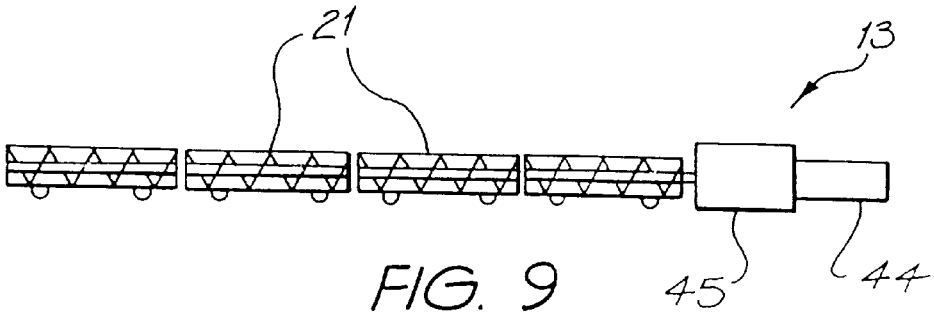
Figure 10:
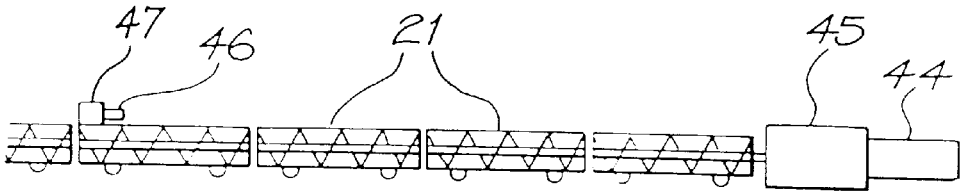
Figure 11:
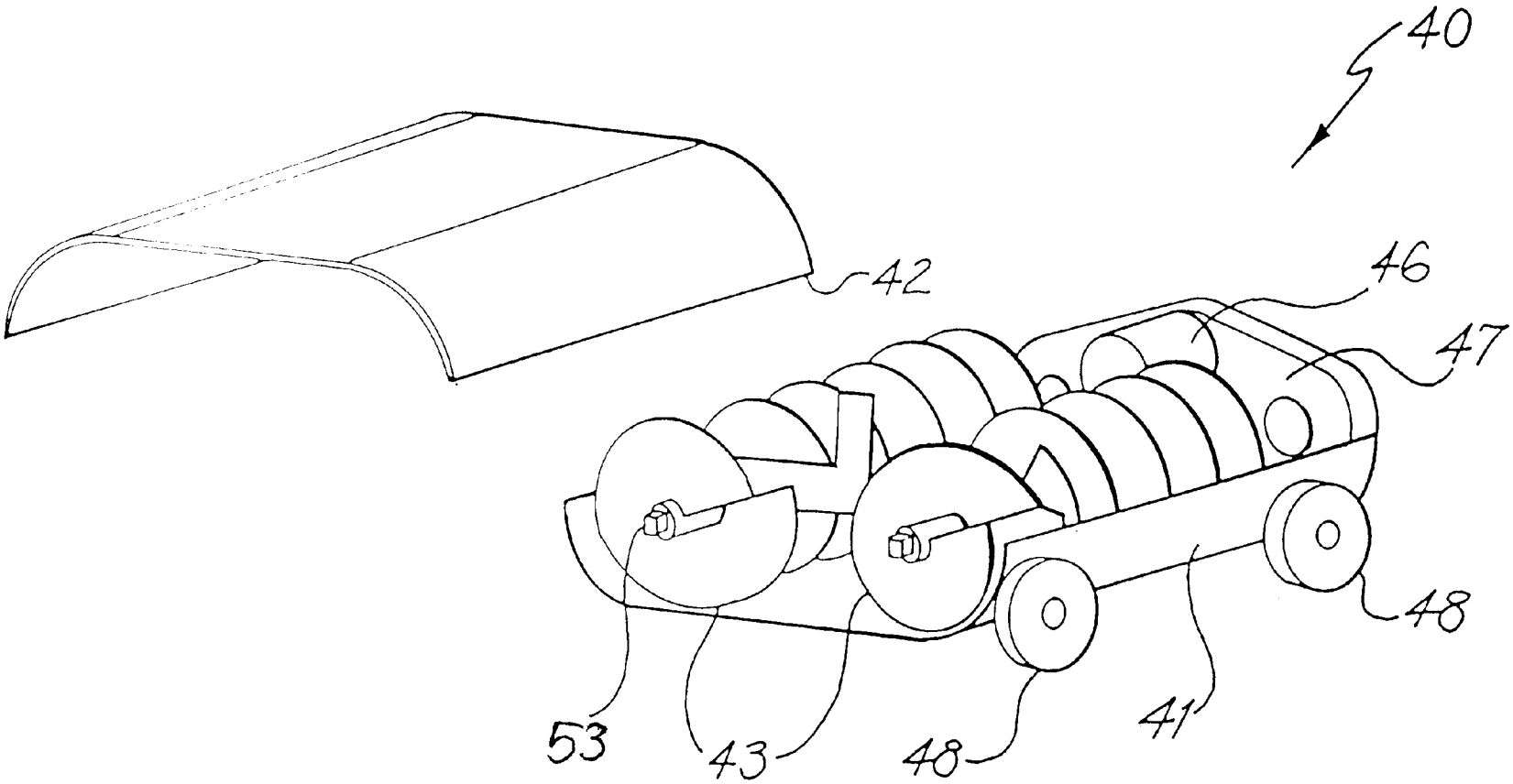
FIG. 11 is a schematic parts exploded perspective view of an auger conveyor module employed in the car train of FIGS. 8 to 10.

The conveyor 35 would need to be pivotably mounted enabling it to follow movement of the last car 21, as best seen in FIG. 7. When a further car 21 is being added, the position of the conveyor 35 would be moved to the position (a). As the last car 21 moves, the conveyor 35 would be pivotably moved until it reached its position (b).

Thus, the flow of mined product is interrupted from the train when the receiving chute assembly comprised of 33 and 34 and conveyor 35, is disconnected from the last car 21, when a new car 12 is added into the train.

Mounted on the frame 32 is a cable real 36 from which there would extend a conduit containing hydraulic and/or electric lines to extend to the miner 11. From there, hydraulic and/or electric power may be delivered to the cars 21.

Preferably the frame 32 would be supported on driven tracks 37.

Also mounted on the frame 32 would be a control cabin 38 where from the apparatus 10 would be controlled.

In a further preferred embodiment, the miner 11 would be provided with traction brakes 54.

As indicated previously, each of the cars 21 has a length of conveyor. The conveyor lengths are ranged in cascade so the material is moved along the conveyor lengths to the launch vehicle 13. More particularly, the conveyor lengths are belt conveyors.

In FIGS. 8 to 11, the conveyors employed in each of the cars 21 are auger conveyors. Each of the cars 21 has smooth external surfaces, such as sides and top to minimize friction forces. The cars 21 are also provided with wheels 48.

Each of the cars 21 is provided with a conveyor assembly 40. Each assembly 40 includes an outer housing including two housing parts 41 and 42 which cooperate to generally enclose a cavity housing two auger lengths 43 which are caused to rotate about their longitudinally axes in opposite rotational directions. Each of the assemblies 40 cooperates with the next adjacent assemblies 40 located on the adjacent cars so that in effect the augers 43 form a continuous train along which the material being mined is conveyed.

The launch vehicle 13 would be provided with a motor 44 which drives a gear train 45 which transfers rotational power to the augers 43. If so required, one or more of the cars 21 can be provided with a motor 46 and gear train 47 to aid in driving the string of augers 43. Typically, the motor 46 would be fluid or electrically driven. If electrically driven, the motor 46 would be coupled to the gear train 47 by a fluid coupling, or would be a soft start synchronized speed motor.

Each of the conveyors 43 would be provided at one extremity with a square projection 53 which would be drivingly received within a correspondingly shaped sprocket in the next adjacent auger so that power is transmitted therebetween.

The motor 44 and gear train 45 would be mounted within the launch vehicle 13.

In the above described embodiments there is contained an invention in respect of a method of highwall mining including forming an inclined mine tunnel. However, the apparatus 10 may also be employed in horizontal mine tunnel operations. The above described embodiments also contain an invention in respect of the miner.

Preferable in respect of the train 12, the cars (for example the car 40 of FIG. 11) has smooth external surfaces and wheels to reduce frictional forces. This minimizes forces required to withdraw the train. This is of particular advantage after a roof fall.

We claim:

1. A method of highwall mining comprising the steps of:

providing a continuous miner for movement in a predetermined direction and having a chassis with a cutter head mounted for movement generally transverse of and generally parallel to said direction relative to said chassis;

attaching to the miner a train of cars to receive mined material provided by the miner, the cars extending from the miner in a direction opposite the normal mining direction of travel of the miner;

applying a force to the train at a position remote from the miner so as to provide for advancement of the train down an inclined mine tunnel;

providing a hydraulic ram extending between a lowermost one of the cars and said miner to move the miner relative to the lowermost car so that the lowermost car provides a reaction force for forces generated by the miner; and wherein the cutter head is moved generally parallel to and then transverse to said direction to mine said material.

2. The method of claim 1, further including the steps of:

providing a launch vehicle for the cars so that a last one of the cars of the train is adjacent the launch vehicle; and wherein said launch vehicle applies said force to said last car.

3. The method of claim 2, further including the step of adding additional cars to the train via the launch vehicle as the train advances down the inclined mine tunnel.

4. The method of claim 1, wherein at least one hydraulic ram provides said force applied to the train at a position remote from the miner, and a hydraulic ram means provides the force to control cutting head displacement.

5. The method of claim 1, wherein said train is intermittently moved enabling further cars to be added to the train.

6. The method of claim 1, further including the step of arranging the train of cars so that mined material passes along individual cars for delivery to the next adjacent car in a cascade manner.

7. The method of claim 1, wherein the train of cars provide augers to transport the mined material, with at least some of the cars provided with drive means for the augers.

8. The method of claim 1, wherein sumping and shearing at a mine face is conducted while the train of cars is stationary.

9. The method of claim 1, wherein initially said force is in a direction toward said miner until a predetermined number of cars exist in said train whereat said force is in the opposite direction away from said miner.

10. A miner comprising:

a chassis;

non driven tracks supporting the chassis on a ground surface;

a cutter head supported on the chassis for movement in a direction generally transverse and longitudinal of the intended direction of movement of the miner;

a first hydraulic ram operatively extending between the chassis and cutter head to cause the transverse movement of the cutter head; and a second hydraulic ram connected to the cutter head for attachment to an end car of a mine car train to cause the longitudinal movement of the cutter head.

11. The miner of claim 10, further including traction brakes operatively associated with the tracks.

12. The miner of claim 11, further including a pair of lower links pivotally attached to the chassis for pivoting movement about an axis generally transverse of the tracks, and extending upwardly therefrom, an upper link extending between upper ends of the lower links and being pivotally attached thereto; and wherein the second hydraulic ram causes pivoting of the lower links to cause the longitudinal movement of the cutter head.

13. In combination, the miner of claim 11 and a train of conveyor cars, said cars having smooth exterior surfaces to minimize frictional forces.

* * * * *